US005609005A

United States Patent [19]

Schierloh et al.

[11] Patent Number: 5,609,005

[45] Date of Patent: Mar. 11, 1997

[54] FOUNDATION CONNECTOR FOR TILT-UP CONCRETE WALL PANEL AND METHOD OF USE

[75] Inventors: David M. Schierloh, Centerville; Kurt S. Eyring, Dayton, both of Ohio

[73] Assignee: Con/Steel Design Systems, Inc., Dayton, Ohio

[21] Appl. No.: 691,097

[22] Filed: Aug. 1, 1996

[51] Int. Cl.[6] ..... E04B 1/38

[52] U.S. Cl. ..... 52/699; 52/708; 52/293.1; 52/293.3; 52/295; 52/250; 52/274; 52/285.2; 52/745.2; 52/745.21; 264/35; 249/83; 249/91

[58] Field of Search ..... 52/126.4, 127.7, 52/293.3, 295, 699, 701, 704, 707, 708, 745.09, 745.11, 745.2, 293.1, 293.2, 745.21, 250, 274, 285.2; 264/35; 249/83, 91

[56] References Cited

U.S. PATENT DOCUMENTS

| | | | |
|---|---|---|---|
| 1,815,492 | 7/1931 | Bradley | 52/293.1 X |
| 2,137,767 | 11/1938 | Betcone | 52/274 |
| 3,055,460 | 9/1962 | Maroney | 52/293.3 |
| 3,195,312 | 7/1965 | Rumsey | 52/293.1 X |
| 3,334,455 | 8/1967 | Russell | 52/126.4 |
| 4,202,149 | 5/1980 | Betrue | 52/699 |
| 4,338,757 | 7/1982 | Witschi et al. | 52/699 |
| 4,481,743 | 11/1984 | Jelle | 52/126.4 X |
| 5,491,948 | 2/1996 | Harris | 52/250 X |

*Primary Examiner*—Robert Canfield
*Attorney, Agent, or Firm*—Jacox, Meckstroth & Jenkins

[57] ABSTRACT

A series of metal connectors each have parallel anchor rods welded to the shorter flange of a right angle section, a cavity defining member attached to the wider flange, and right angle mounting brackets welded to opposite ends of the angle section. The connectors are attached to the base form for tilt-up concrete wall panels and become embedded in the wall panels. After each cured wall panel is erected and seated on a concrete foundation, a hole is drilled on an incline into the foundation through the cavity and a hole within the wider flange of each angle section. A threaded anchor rod is inserted into the hole and secured to the foundation by adhesive, and a nut is threaded onto each rod within the tubular member for securing each wall panel to the foundation.

19 Claims, 1 Drawing Sheet

FOUNDATION CONNECTOR FOR TILT-UP CONCRETE WALL PANEL AND METHOD OF USE

BACKGROUND OF THE INVENTION

In the construction of a concrete building with tilt-up panels, a concrete peripheral foundation and a concrete floor slab are poured. After the forms for the foundation and floor slab are removed, the forms for a series of wall panels are placed on the concrete floor slab. The concrete wall panels are poured directly on the floor slab with a parting agent therebetween. The cured concrete wall panels are then successively tilted to an upright or vertical position and seated on the concrete foundation, usually with continuous grout and plastic shims therebetween to support each wall panel in a precise vertical position. The weight of the concrete wall panels and the roof supported by the wall panels is normally sufficient to maintain the wall panels in their erected vertical positions on the foundation, especially after earth is back filled to cover the foundation and lower edge portions of the wall panels.

It has been found desirable with the construction of some buildings with tilt-up concrete wall panels to provide a system for connecting the wall panels to the concrete foundation in order to resist any lateral or uplift forces on the wall panels relative to the foundation, for example, as may be produced by a hurricane or an earthquake. While it is known to attach base plates to the wall panels and to embed prelocated vertical anchor bolts within the foundation for receiving the base plates, there is a problem in obtaining precision location of the base plate on the wall panels and corresponding precision location of the bolts within the foundation so that the wall panels are precisely positioned and aligned after they are erected.

SUMMARY OF THE INVENTION

The present invention is directed to an improved and simplified method for connecting tilt-up concrete wall panels to a supporting concrete foundation for resisting lateral forces on the wall panels, and to the construction and use of special metal connectors which tie the base of each wall panel to the foundation. The connecting system of the invention eliminates the need to prelocate embedded bolts or elements within the concrete foundation before it is poured and also eliminates the problem of aligning the bolts with holes within base plates attached to the wall panels. The connector system of the invention also provides for connecting the wall panels to the foundation from outside the building so as not to interfere with construction operations within the building.

In accordance with one embodiment of the invention, each wall panel is connected or tied to the foundation by a set of embedded metal connectors which are attached to the forms for the concrete wall panels before they are poured. Each connector includes an angle section having one flange welded to a plurality of anchor rods which project into the wall panel. Each connector also includes a tubular member which is welded to the other flange and projects to the outer surface of the wall panel to define a cavity aligned with a hole formed within the other flange. After each wall panel is poured, cured and erected to its aligned vertical position supported by the foundation, an inclined hole is drilled into the foundation with a drill bit extending through each tubular member and the hole within the connector flange. A threaded tie rod is inserted into the hole and secured with epoxy adhesive, and a nut is tightened on each tie rod for rigidly connecting each vertical wall panel to the foundation.

Other features and advantages of the invention will be apparent from the following description, the accompanying drawing and the appended claims.

DESCRIPTION OF THE PREFERRED EMBODIMENT

Figure 1:
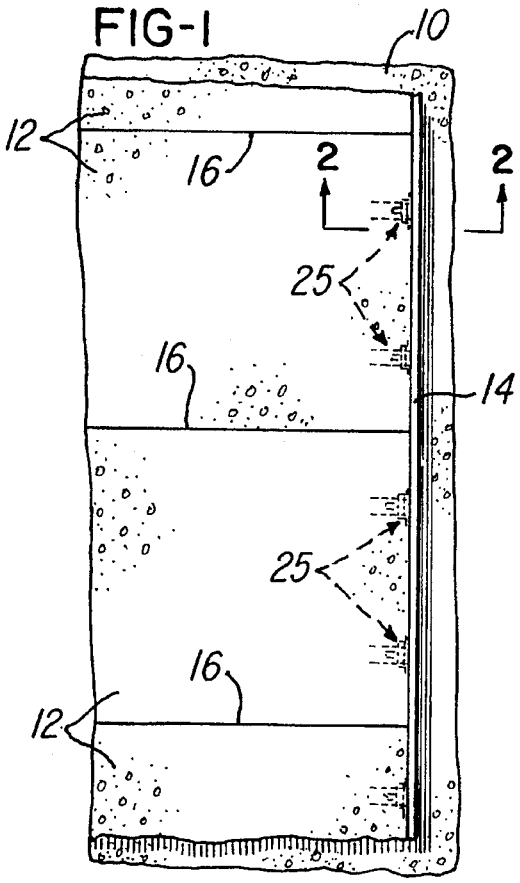
FIG. 1 is a fragmentary plan view of horizontal concrete wall panels which are poured within forms supported by a concrete floor slab and illustrating the location of connectors constructed and used in accordance with the invention.
Figure 2:
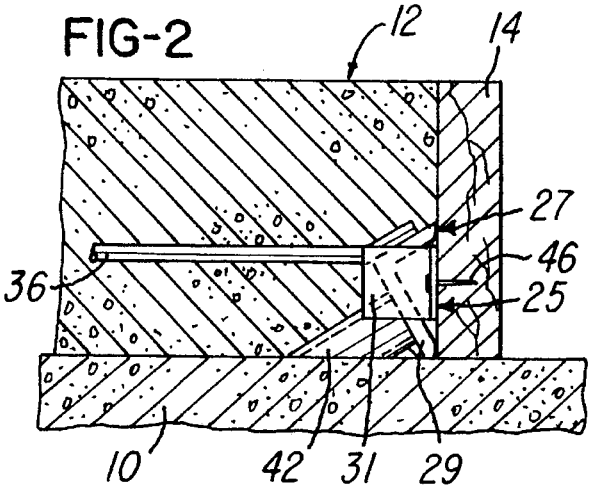
FIG. 2 is an enlarged fragmentary section taken generally on the line 2—2 of FIG. 1.
Figure 3:
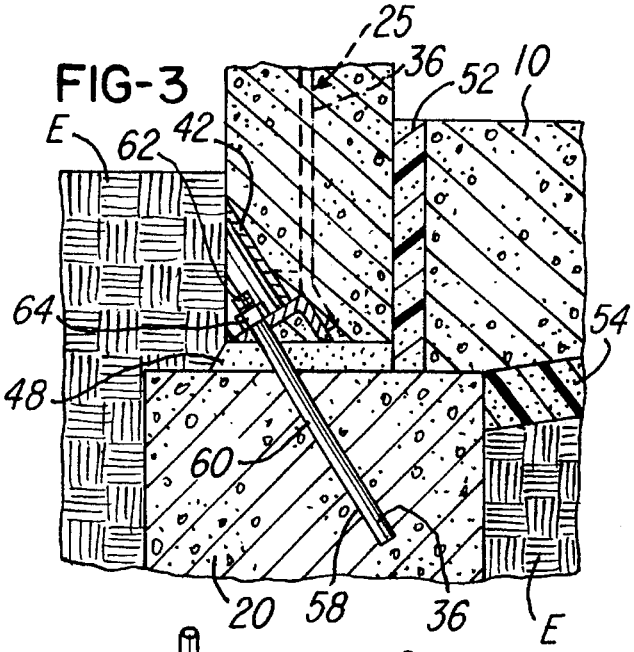
FIG. 3 is an enlarged fragmentary section of the connector shown in FIG. 2 for securing a wall panel to a supporting foundation.

FIG. 1 illustrates a poured concrete horizontal floor slab 10 for a building and which has embedded reinforcing steel rods or rebars (not shown). The slab forms a support for pouring a series of tilt-up concrete wall panels 12 which also have embedded reinforcing steel rods or rebars (not shown). In order to pour the wall panels 12, wall forms are prelocated on the floor slab 10, and the forms include a linear base form 14 which may be constructed of wood and preferably extends the full length of the floor slab 10 for the building. The wall forms also include thin form members 16 which extend from the base form 14 to the top or header form (not shown) for separating the concrete wall panels 12. After the wall panels are poured and cured, each panel is tilted upwardly or erected from its horizontal poured position (FIGS. 1 and 2) to a vertical erected position (FIG. 3). As shown in FIG. 3, the concrete floor slab 10 has a peripheral portion which overlaps and rests upon an underlying edge portion of a poured concrete foundation 20 which extends around the perimeter of the building.

Figure 4:
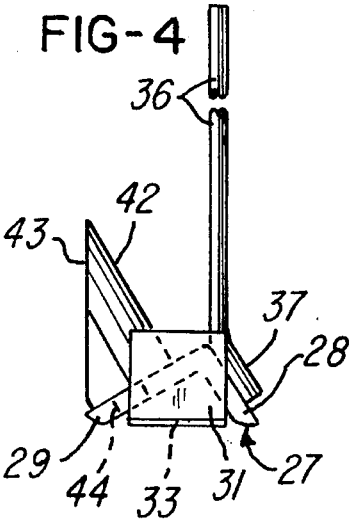
FIGS. 4 and 5 are an end view and a perspective view, respectively, of the connector shown in FIGS. 1–3 and constructed in accordance with the invention.
Figure 5:
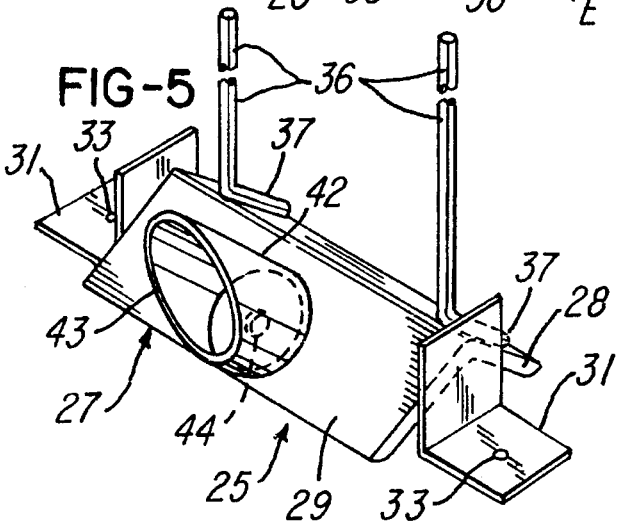

In accordance with the present invention, before the concrete wall panels 12 are poured within the wall forms, a plurality or pair of metal connectors 25 are attached to the bottom form 14 for each of the wall panels 12, as shown in FIG. 1. The construction of each metal connector 25 is best shown in FIGS. 4 and 5 and includes a right angle section or member 27 having a shorter flange or leg 28 and a longer flange or leg 29. A right angle mounting bracket 31 is welded to each end of the angle member 27, and each bracket 31 has a hole 33 within its bottom leg or flange which extends within a plane defined by the edge surfaces of the legs 28 and 29 of the angle member 27. A pair of parallel spaced anchor members or rods 36 have lower angular end portions 37 welded to the leg 28 of the angle member 27, and the upper portions of the anchor rods 36 extend perpendicular to the bottom flanges of the mounting brackets 31.

Each of the connectors 25 also includes a cavity defining member 42 which is illustrated in the form of a tubular or cylindrical section or member located within the center portion of the flange 29. The lower radial end surface of the tubular member 42 is welded to the flange 29, and a transverse elliptical surface 43 forms the opposite end of the tubular member 42 so that the surface 43 extends in a plane parallel to the anchor rods 36. The leg or flange 29 of each connector has a hole 44 within the center of the tubular section 42.

Before the concrete wall panels 12 are poured, a series of the connectors 25 are attached to the bottom form 14 for the wall panels so that preferably, two or more connectors 25 will be located at the base of each wall panel. As shown in FIG. 2, each connector 25 is attached to the wall form 14 by a pair of fasteners 46 such as nails or screws which extend through the corresponding holes 33 within the mounting brackets 31. When each connector 25 is position as shown in FIG. 2, the elliptical end surface 43 of the corresponding tubular member 42 extends adjacent or contacts the top surface of the floor slab 10. Thus when the concrete is poured within the wall forms, the concrete surrounds each of the connectors 25 but does not enter the cavity within each of the tubular members 42.

After the concrete forming the wall panels 12 cures, the wall forms, including the bottom form 14 are removed from the wall panels, and the head of each nail or fastener 46 is pulled through the corresponding hole 33 with a suitable tool. Each wall panel 12 is then tilted or erected to a vertical position (FIG. 3) where the vertical wall panel is precisely positioned on the upper surface of the foundation 20 by means of flat plastic shim plates (not shown). A continuous layer 48 of a grout material is located between the bottom end surfaces of the wall panels 12 and the upper surface of the foundation 20, as shown in FIG. 3. Preferably, strips 52 of expanded rigid plastic foam insulation material are located between the inner surface of each wall panel 12 and the opposing edge surface of the floor slab 10, and panels 54 of similar rigid foam insulation material are placed on the earth E under the outer edge portion of the concrete floor slab 10 before the concrete is poured.

After each of the wall panels 12 is erected and precisely positioned by means of the shims and grout layer 48, an inclined hole 58 is drilled into the foundation 20 by inserting a drill bit through each of the tubular members 42 and the center hole 44 within the leg or flange 29 of the angle member 27. Preferably, each hole 58 is drilled with its axis at an angle of about 60° with respect to the top surface of the foundation 20, as shown in FIG. 3.

Epoxy adhesive is injected into each of the inclined holes 58, and a cylindrical anchor member or rod 60 is inserted into the hole. Each of the anchor rods 60 has an upper threaded end portion 62 which projects through the hole 44 and into the cavity defined by the tubular section 42. After the epoxy adhesive cures, a nut 64 is threaded onto the upper end portion of each rod 60 and is tightened so that each wall panel 12 is positively and rigidly connected to the foundation 20 as a result of the connectors 25 embedded within the wall panels and the corresponding inclined anchor rods 60 embedded in the foundation.

From the drawing and the above description, it is apparent that a connector constructed and used in accordance with the invention for tying concrete wall panels to a concrete foundation, provides desirable features and advantages. For example, the construction of each embedded connector 25 and the inclined position of the corresponding anchor rod 60 provide for substantial resistance to lateral or uplift forces on the wall panels 12, as might occur during an earthquake or hurricane. The connecting or anchoring system of the invention also eliminates the need to prelocate bolts or other elements in the concrete foundation before it cures and the associated alignment problem with anchor plates on the bottom of the wall panels. That is, each of the wall panels 12 is precisely positioned on the foundation 20 before the corresponding anchor rod holes 58 are drilled. In addition, the drilling and insertion of the threaded anchor rods 60 may all be performed from outside of the wall panels or building in order not to interfere with work being performed inside the wall panels or within the building. Each of the fasteners or nuts 64 and the outer threaded end portion 62 of the corresponding rods 60 and the exposed surfaces of the angle member 27 and tubular member 42 may also be easily coated after assembly to prevent corrosion, for example with a bituminous primer material. The cavity within each of the tubular members 42 may also be filled with grout after the corresponding nut is tightened and before back filling the earth E on the outside of the building. Furthermore, all of the connectors 25 are also located below the top surface of the floor slab 10 in order not to interfere with cutting an opening such as a doorway within a wall panel 12 above the floor slab.

While the form of connector and the method of using the connector herein described constitute a preferred embodiment of the invention, it is to be understood that the invention is not limited to the precise method and form of connector described, and that changes may be made therein without departing from the scope and spirit of the invention as defined in the appended claims. For example, the cavity defining members 42 may be an attached solid wood or foam member which is removed after the concrete is cured in order to define a cavity within the concrete.

The invention having thus been described, the following is claimed:

1. A connector assembly for securing a tilt-up concrete wall panel to a supporting concrete foundation, comprising a metal anchor member adapted to be embedded in the wall panel and having an inclined surface with a hole, means for positioning said anchor member adjacent the bottom surface of the wall panel, a cavity defining member secured to said inclined surface adjacent said hole, said cavity defining member having an outer end surface adapted to extend substantially flush with a side surface of the wall panel, a threaded rod adapted to extend through said cavity and said hole and into an inclined hole formed within the foundation, and a threaded fastener adapted to be secured to an upper end portion of said rod to tie said anchor member and the wall panel to the foundation.

2. A connector assembly as defined in claim 1 and including a plurality of generally parallel concrete anchor rods welded to said metal anchor member.

3. A connector assembly as defined in claim 1 and including a pair of angular mounting brackets welded to opposite ends of said metal anchor member.

4. A connector assembly as defined in claim 1 wherein said metal anchor member comprises an angle member having two substantially perpendicular flanges each having an inclined outer surface, a plurality of reinforcing rods welded to said outer surface of one said flange, and said cavity defining member is attached to said outer surface of the other said flange.

5. A connector assembly as defined in claim 4 wherein said outer surface of the other said flange extends at an angle of about thirty degrees with respect to a plane defined by outer edges of said flanges.

6. A connector assembly for securing a tilt-up concrete wall panel to a supporting concrete foundation, comprising a metal anchor member adapted to be embedded in the wall panel and including an angle member having two substantially perpendicular flanges each having an inclined outer surface, means for positioning said anchor member adjacent the bottom surface of the wall panel, a cavity defining member attached to one of said inclined outer surfaces, said cavity defining member having an outer end surface adapted to extend substantially flush with a side surface of the wall panel, a threaded rod adapted to extend through said angle member and into an inclined hole formed within the foundation, and a threaded fastener adapted to be secured to an upper end portion of said rod to tie said anchor member and the wall panel to the foundation.

7. A connector assembly as defined in claim 6 and including a plurality of generally parallel concrete anchor rods having end portions welded to the other said inclined outer surface of said angle member.

8. A connector assembly as defined in claim 6 wherein said positioning means comprise a pair of angular mounting brackets welded to opposite ends of said angle member.

9. A connector assembly as defined in claim 6 wherein said one of said outer surfaces extends at an angle of about thirty degrees with respect to a plane defined by outer edges of said flanges.

10. A method of securing a tilt-up concrete wall panel to a supporting concrete foundation, comprising the steps of forming at least one rigid connector with a cavity defining portion, positioning the connector adjacent a horizontal bottom form for the wall panel, pouring the wall panel and embedding the connector within the wall panel with the cavity defining portion extending to a side surface of the wall panel, tilting the wall panel to a vertical position and positioning the wall panel on the foundation, drilling an inclined hole into the foundation through the cavity defining portion and a hole within the connector, inserting and securing within the hole in the foundation a rod having an upper end portion extending through the connector into the cavity defining portion, and securing a fastener to the upper end portion of the rod to tie the embedded connector and the wall panel to the foundation.

11. A method as defined in claim 10 and including the steps of forming the connector from a metal angle member having an inclined surface, and locating the cavity defining portion on the inclined surface.

12. A method as defined in claim 11 and including the step of welding at least one anchor bar to the metal angle member.

13. A method as defined in claim 11 and including the step of securing a pair of form mounting brackets to opposite ends of the metal angle member.

14. A method as defined in claim 10 and including the steps of forming the connector from a section of a metal angle member having two generally perpendicular flanges with outer surfaces, welding a plurality of anchor rods to the outer surface of one flange, attaching the cavity defining portion to the outer surface of the other flange, and forming on the cavity defining portion an end surface extending generally flush with the side surface of the wall panel.

15. A method of securing a tilt-up concrete wall panel to a supporting concrete foundation, comprising the steps of forming a plurality of rigid metal connectors each including a cavity defining member, positioning the connectors adjacent a horizontal bottom form for the wall panel with the cavity defining members extending downwardly to a supporting surface for the wall panel, pouring the wall panel and embedding the connectors within the wall panel, tilting the wall panel to a vertical position and positioning the wall panel on the foundation, drilling an inclined hole into the foundation through each cavity and a hole within each connector, inserting and securing within each hole in the foundation a rod having an upper threaded end portion extending through the hole within the connector into the cavity, and securing a fastener to the upper end portion of each rod to tie each embedded connector and the wall panel to the foundation.

16. A method as defined in claim 15 and including the steps of forming each metal connector with an inclined surface, and locating the corresponding cavity defining member on the inclined surface.

17. A method as defined in claim 15 and including the step of welding a plurality of generally parallel anchor bars to each metal connector.

18. A method as defined in claim 15 and including the step of securing a pair of angular form mounting brackets to opposite ends of each metal connector.

19. A method as defined in claim 15 and including the steps of forming each metal connector from a section of a metal angle member having two generally perpendicular flanges with outer surfaces, welding a plurality of anchor rods to the outer surface of one flange, attaching a tubular displacement member to the outer surface of the other flange, and forming on each tubular displacement member an oval end surface extending generally flush with the side surface of the wall panel.

* * * * *